US006000692A

United States Patent [19]

Lee

[11] Patent Number: 6,000,692

[45] Date of Patent: Dec. 14, 1999

[54] PAPER SWITCHING DEVICE FOR PRINTER

[75] Inventor: Yong-Hyun Lee, Suwon, Rep. of Korea

[73] Assignee: SamSung Electronics Co., Ltd., Suwon, Rep. of Korea

[21] Appl. No.: 08/864,274

[22] Filed: May 27, 1997

[30] Foreign Application Priority Data

May 25, 1996 [KR] Rep. of Korea ..... 96/17858

[51] Int. Cl.[6] ..... B65H 9/04; B65H 1/08; B65H 1/00

[52] U.S. Cl. ..... 271/248; 271/253; 271/148; 271/171

[58] Field of Search ..... 271/248, 253, 271/148, 171

[56] References Cited

U.S. PATENT DOCUMENTS 4,457,507 7/1984 Ishikawa et al. .
4,828,245 5/1989 Shimogawara .
5,172,902 12/1992 Hashimoto et al. ..... 271/164
5,292,117 3/1994 Takagi et al. .
5,332,209 7/1994 Romansky et al. .
5,348,283 9/1994 Yanagi et al. .
5,433,427 7/1995 Ishakawa et al. ..... 271/126
5,611,528 3/1997 Nakamura et al. ..... 271/164
5,628,504 5/1997 Lyga ..... 271/171
5,890,711 2/1997 Kim ..... 271/127

*Primary Examiner*—Donald P. Walsh
*Assistant Examiner*—Daniel K Schlak
*Attorney, Agent, or Firm*—Robert E. Bushnell, Esq.

[57] ABSTRACT

A paper switching device with a simplified structure and assembly that facilitates the conveyance of thick paper such as envelopes and post cards, preventing jamming during paper. conveyance. The device includes, a recess which is formed at one side on a knock-up plate to mate with a guide, and hinge pins protruding from the sides of the knock-up plate, which are inserted into protrusions on the guide so that the guide moves up and down.

12 Claims, 3 Drawing Sheets

PAPER SWITCHING DEVICE FOR PRINTER

CLAIM OF PRIORITY

This application makes reference to, incorporates the same herein, and claims all benefits accruing under 35 U.S.C. §119 from an application for Paper Switching Device For Printer earlier filed in the Korean Industrial Property Office on 25 May 1996 and there duly assigned Ser. No. 17858/1996.

FIELD OF THE INVENTION

The present invention relates to a paper switching device for use in a printer, and more particularly, to a paper switching device with a simplified structure and an assembly which facilitates the printing of thick paper such as envelopes and post cards, preventing sheets of paper from jamming.

BACKGROUND OF THE INVENTION

In general, most printers include an automatic paper feeding device for automatically feeding paper, where the automatic paper feeding device includes a separator, which is in contact with the front of the paper, to separate and feed the paper one by one.

In the automatic paper feeding device, when a control signal is received to convey the paper to print, the paper feeding roller operates to convey the paper. When the paper is conveyed, the front end of the paper is separated by the separator, so that the paper is supplied one sheet at a time. Such a separator easily separates ordinary printer paper, supplying it one sheet at a time. However, thick paper such as envelopes and post cards, cannot be conveyed through the separator because the front end of the thick paper jams and cannot be conveyed any more.

There needs to be different conveyance paths for standard and thick paper, which require a mechanism to separate the feed of standard paper from the feed of thick paper. As shown in FIGS. 1 and 2, when thick paper is conveyed through a printer 100's "L"-shaped lever 101, which is installed at the side of the paper feeding device, the "L"-shaped lever is turned so that the thick paper can be conveyed with one face being in contact with the "L"-shaped lever. Accordingly, it is conveyed in a way that bypasses the separator.

Unfortunately, this paper switching device has an ugly appearance and is difficult to use. What is needed is a paper guide that allows thick documents such as envelopes and postcards to bypass the paper separator. U.S. Pat. No. 4,457,507 for a Sheet Feeding Apparatus to Ishikawa et al. discloses a sheet feeding apparatus that contains a fixed guide and an adjustable guide. In addition, a roller is shown for separating sheets of paper fed into the printer.

U.S. Pat. No. 4,828,245 for a Sheet Feeder Suitable For Feeding Thick Sheets to Shimogawara discloses a thick sheet feeding attachment having a pair of slits separated by a distance smaller than the distance between pawls used for separating thin sheets, thereby disabling the separating function of the pawls.

U.S. Pat. No. 5,348,283 for a Sheet Feeding Apparatus Having Sheet Separating Means With Adjustable Feeding Force to Yanagi et al. discloses a sheet feed apparatus can accommodate both thin sheets as well as thick sheets like postcards and envelopes.

I have not seen a sheet feeding apparatus made up of a guide positioned on a knock-up plate and orientated to guide paper in a direction perpendicular to the paper's movement so as to bypass the sheet separator.

SUMMARY OF THE INVENTION

It is therefor an object to provide a guide mounted on a knock-up plate, the guide being oriented to guide paper in a direction perpendicular to the paper's movement so as to bypass the sheet separator.

To achieve these and other advantages in accordance with the purpose of the present invention, as embodied and broadly described, a recess is formed in a knock-up plate which supports sheets of papers, and a guide mates with the recess having a 90° range of movement. When standard paper is fed, the sheets of paper on the knock-up plate are fed. When thick paper is conveyed, it is fed using the guidance of the guide, so that it bypasses a separator before being fed.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE INVENTION

Figure 1:
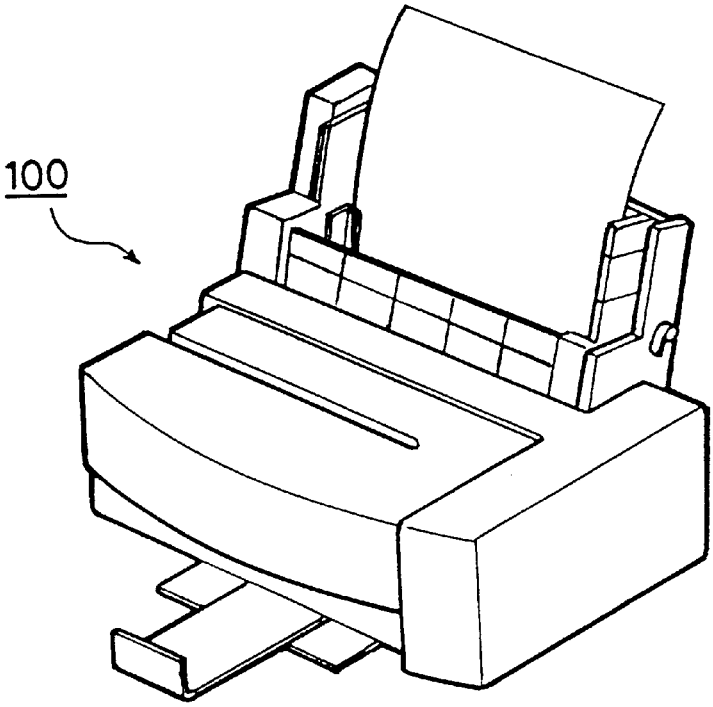
FIG. 1 is a perspective view of a printer.
Figure 2:
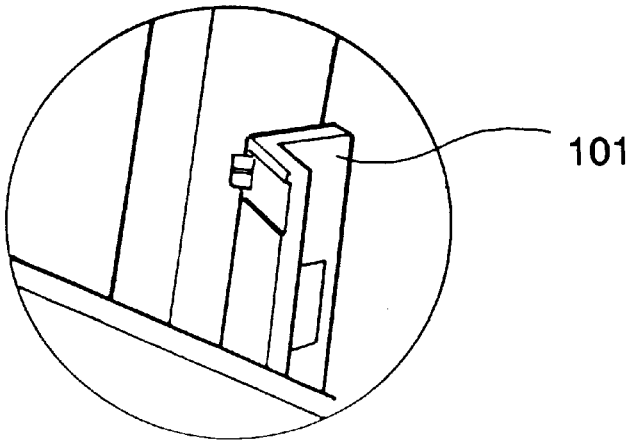
FIG. 2 schematically shows a conventional paper switching device.
Figure 3:
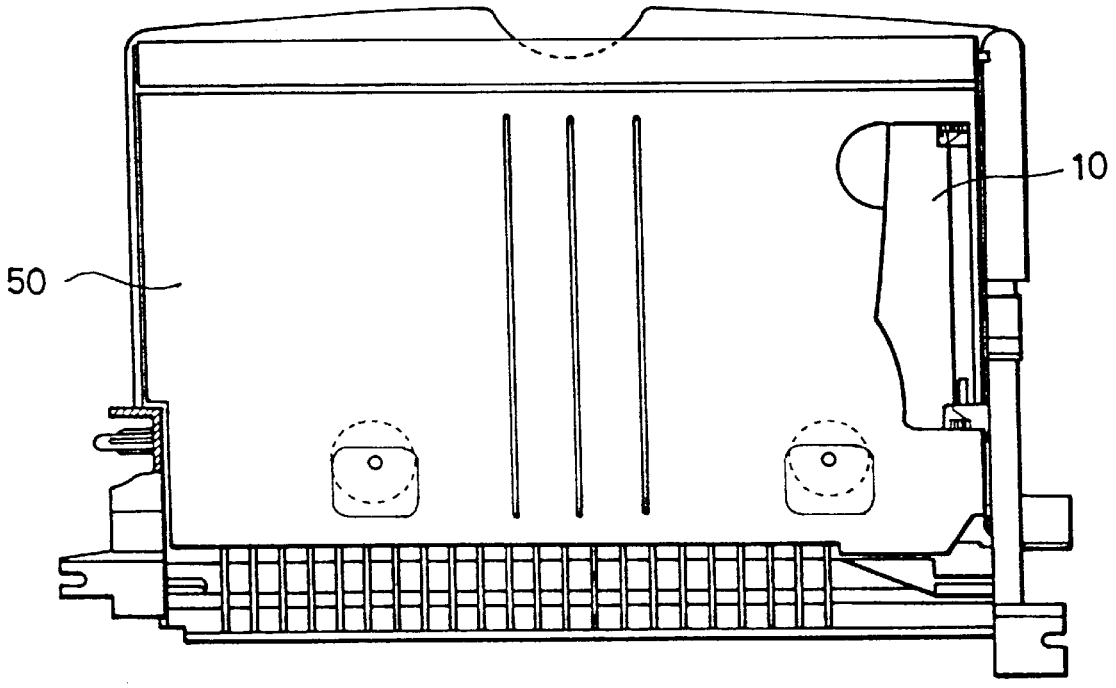
FIG. 3 is a frontal view of a paper switching device of the present invention.
Figure 4:
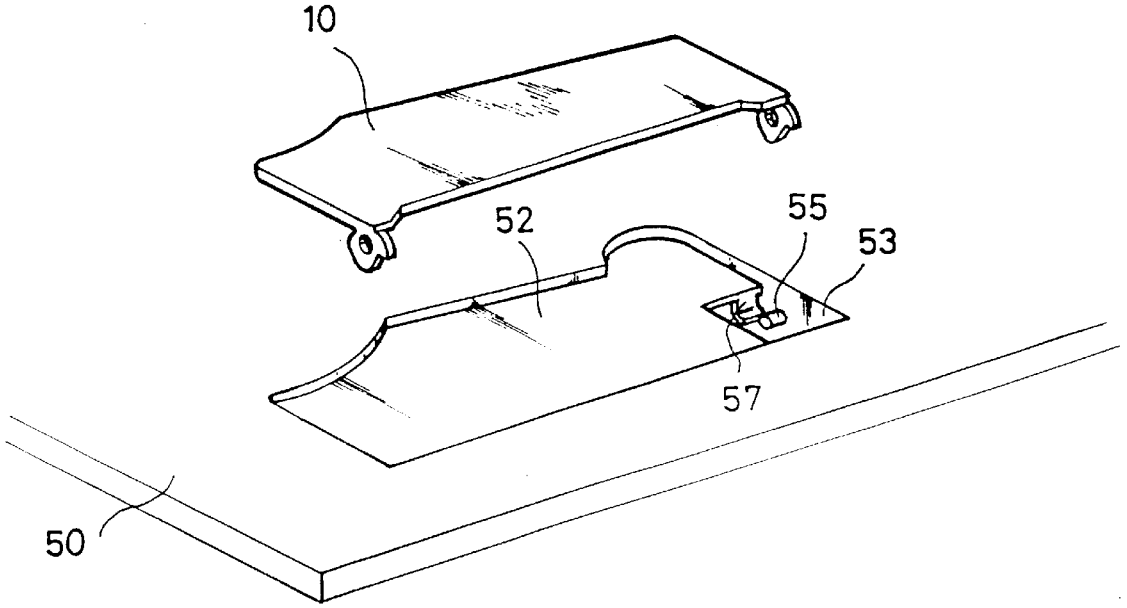
FIG. 4 is an exploded perspective view of important component of the paper switching device of the present invention.

FIGS. 3 and 4 show a recess 52 formed at one side in a knock-up plate 50 which mates with a guide 10. A hinge pin 55 protruding from the side wall of the knock-up plate 50 is inserted into apertures of both protrusions 12 of the guide 10 so that the guide 10 moves up and down.

Both protrusions 12 of the guide 10 are inserted into openings 53 on knock-up plate 50, and an elastic piece 56 is formed in a direction where the protrusions 12 of the guide 10 move in order to elastically support the protrusions 12.

Figure 5:
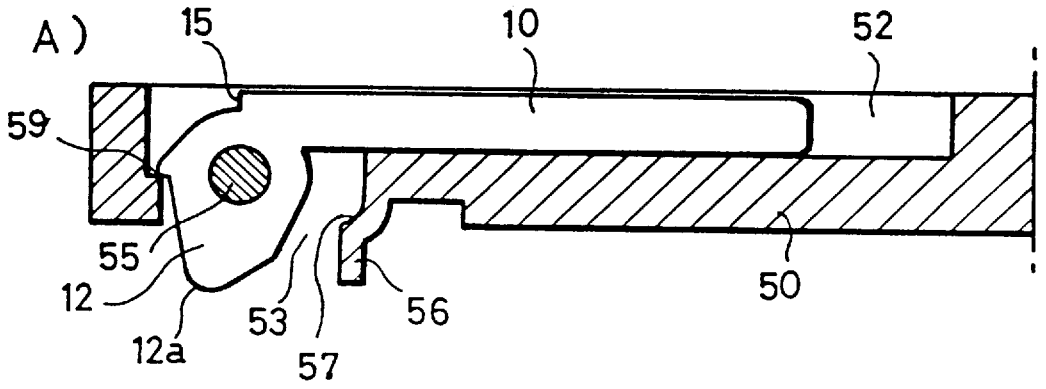
FIGS. 5A and 5B illustrate the operation of the paper switching device of the present invention.
Figure 5:
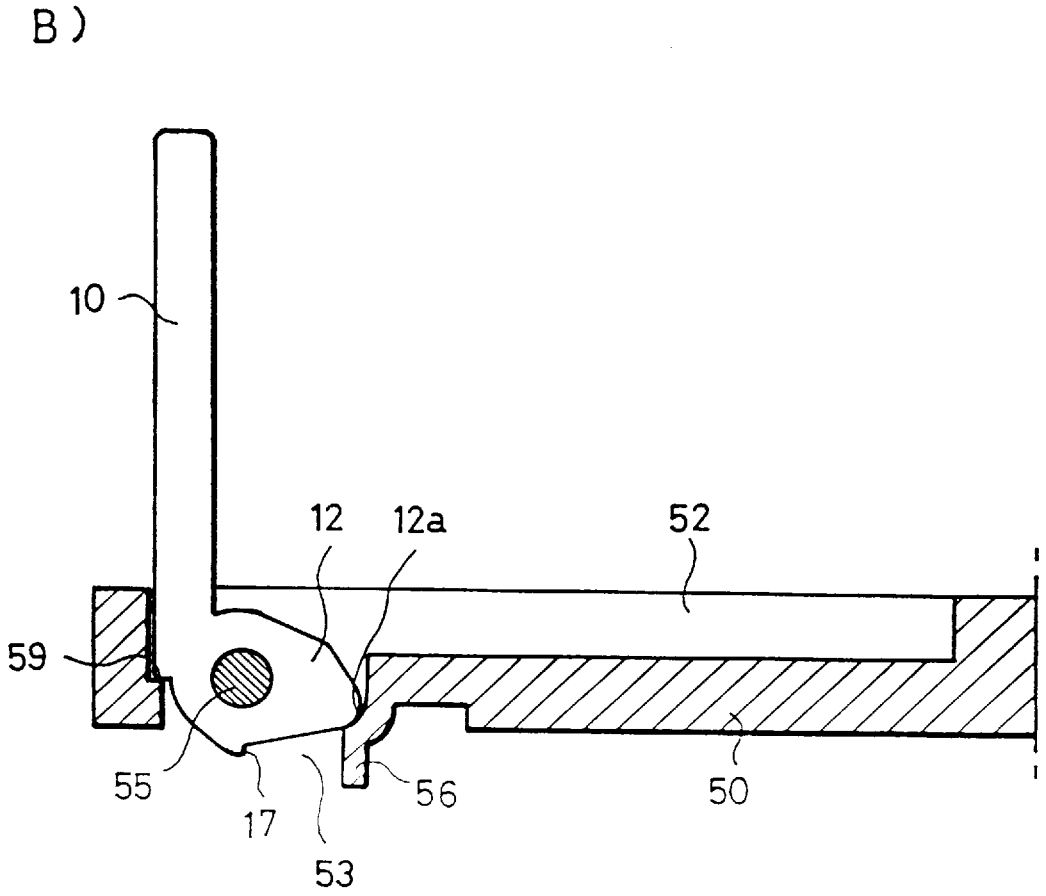

As shown in FIG. 5A, the guide 10 lies down on the recess 52 in knock-up plate 50. The top of the guide 10 is slightly lower than that of the knock-up plate 50 so that sheets of standard paper are conveyed on top of the guide 10 without resistance. As depicted in FIG. 5B, when a sheet of thick paper, such as envelopes and post cards is conveyed, the guide 10 is erected, and then the thick paper conforms to the wall of the guide 10 for its conveyance. In this situation when the guide 10 turns about hinge pin 55, the front end 12*a* of the protrusions 12 is raised, by pushing the elastic piece 56 at the side wall of the opening 53 in the knock-up plate 50. The moment the front end 12*a* passes the bending portion, the elastic piece 56 returns to its original position and supports the front end 12*a* of the protrusions 12. Here, a projection 15 at the back end of the protrusions of the guide is stopped by a projection 59 on the knock-up plate so that the guide 10 remains at 90° of rotation. Accordingly, the guide 10 stays as shown in FIG. 5B so that paper does not pass through the separator for separating paper at the front end of the knock-up plate, but is directly conveyed to the print unit.

To return the guide 10 to its original position, the end of the guide 10 is turned towards knock-up plate 50, and the elastic piece 56 is then pushed, by the front end 12*a* of the protrusions 12 of the guide, so that the elastic piece 56 is turned over. This operation rotates the guide 10 to be mounted on the recess 52 for the purpose of conveying ordinary paper.

As mentioned above, when the guide for guiding thick paper is not in use, it attaches to the knock-up plate so that the appearance of products is improved, and it is easy to utilize the guide due to its simplified operation.

It will be apparent to those skilled in the art, that various modifications and variations can be made to a paper switching device for a printer of the present invention without departing from the spirit or scope of the invention. Thus, it is intended that the present invention cover the modifications and variations of this invention that come within the scope of the appended claims and their equivalents.

What is claimed is:

1. A paper feeding apparatus comprising a sheet separator and a knock up plate, a guide having a closed position parallel to the knock-up plate when sheets having a first thickness are placed in said paper feeding apparatus and an open position which is transverse to the knock-up plate when sheets of a second and lesser thickness are placed in said paper feeding apparatus, said guide guiding the paper in a direction perpendicular to the paper's movement so as to bypass the sheet separator only when said sheets having a first thickness are placed in said paper feeding apparatus and said guide has said closed position.

2. The apparatus of claim 1, said guide having a pair of protrusions for engaging said knock-up plate when said guide is in said closed position.

3. The apparatus of claim 1, said guide having a first projection for engaging said knock-up plate when said guide is in said closed position.

4. The apparatus of claim 1, said guide having a second projection for engaging said knock-up plate when said guide is in said open position.

5. The apparatus of claim 2, said pair of protrusions displaces an elastic piece of said knock-up plate.

6. A paper switching device for a printer, wherein a recess which is formed at one side on a knock-up plate, mates with a guide, and hinge pins protruding from the side wall of the knock-up plate are inserted into protrusions on the guide so that the guide moves up and down, said guide moves up when sheets of paper having a first thickness are placed on said knock-up plate so that said sheets having a first thickness will be conveyed to a sheet separator and said guide moves down when sheets of paper having a second and larger thickness are placed on said knock-up plate so said sheets having a second thickness will not be conveyed to said sheet separator.

7. The apparatus as claimed in claim 6, wherein said elastic piece is attached to the knock-up plate in a direction where both protrusions of the guide move said elastic piece stably fixing a position of the guide.

8. A paper feeding apparatus comprising a sheet separator and a knock-up plate, a guide being rotatably attached to said knock-up plate, said guide rotatable to a closed position where said guide is parallel to said knock-up plate when sheets having a first thickness are placed in said paper feeding apparatus, said guide being rotatable to an open position where said guide is perpendicular to said knock-up plate when sheets of a second and lesser thickness are placed in said paper feeding apparatus, said guide guiding the paper in a direction perpendicular to the paper's movement so as to bypass the sheet separator only when sheets of said first thickness are placed in said paper feeding apparatus and said guide is in said closed position.

9. The apparatus of claim 8, said guide having a pair of protrusions for engaging said knock-up plate when said guide is in said closed position.

10. The apparatus of claim 9, said pair of protrusions displaces an elastic piece of said knock-up plate.

11. The apparatus of claim 8, said guide having a first projection for engaging said knock-up plate when said guide is in said closed position.

12. The apparatus of claim 8, said guide having a second projection for engaging said knock-up plate when said guide is in said open position.

* * * * *